United States Patent [19]

de Lorenzi

[11] Patent Number: 4,593,616

[45] Date of Patent: Jun. 10, 1986

[54] DABBER PRINTING MACHINE WITH PLURAL DABBERS

[75] Inventor: Silvano de Lorenzi, Urdorf, Switzerland

[73] Assignee: MADAG Maschinen-und Apparatebau Dietikon AG, Dietikon, Switzerland

[21] Appl. No.: 657,522

[22] Filed: Oct. 4, 1984

[30] Foreign Application Priority Data

Oct. 4, 1983 [CH] Switzerland ..... 5394/83

[51] Int. Cl.[4] ..... B41F 17/00

[52] U.S. Cl. ..... 101/163; 101/44

[58] Field of Search ..... 101/39, 41, 44, 163, 101/150

[56] References Cited

U.S. PATENT DOCUMENTS 3,916,784 11/1975 Dubuit ..... 101/163 X
4,060,031 11/1977 Philipp ..... 101/41 X
4,314,504 2/1982 Combeau ..... 101/41

FOREIGN PATENT DOCUMENTS 1902785 9/1969 Fed. Rep. of Germany ..... 101/35
2334179 1/1975 Fed. Rep. of Germany ..... 101/41
911534 11/1962 United Kingdom ..... 101/163
1313301 4/1973 United Kingdom ..... 101/44

*Primary Examiner*—Clifford D. Crowder
*Attorney, Agent, or Firm*—Oblon, Fisher, Spivak, McClelland & Maier

[57] ABSTRACT

A dabber printing machine for printing of workpieces with printing ink wherein a dabber-holder is fastened from below to a first and second vertical carriage (6, 6'). The dabber-holders run parallel to one another. In each case, in one extreme position of the horizontal carriage (7), with which both vertical carriages (6, 6') are connected, the vertical carriages (6, 6') are pressed downward by two levers (14) of a pair of gear units (12). In the other extreme position, such are pressed downward by the levers (14) of the other pair of gear units (12). Thus, the dabber-holders with the dabbers jointly and simultaneously make vertical and horizontal movements in the form of an inverted U. A step of operation of the transfer element from printing station to printing station optically occurs upon every or every other horizontal movement. Thus, indexing of the workpieces to be printed is simplified and the efficiency of the printing machine is doubled.

7 Claims, 10 Drawing Figures

DABBER PRINTING MACHINE WITH PLURAL DABBERS

BACKGROUND OF THE INVENTION

1. Field of the Invention

The invention works on the principle of a dabber printing machine for printing of workpieces with printing ink wherein said workpieces are put in a transfer element moving step by step in the same horizontal plane, with at least one dabber, at least one block, at least one ink trough and an inking and doctor arrangement being utilized.

2. Description of the Prior Art

Known dabber printing machines exhibit only a holder running vertically or horizontally, which carries at least one dabber. If the dabber printing machine is equipped with a stationary holder of the ink trough and block, the carrier, with the dabber, makes vertical and horizontal movements in a path in the form of an inverted U. There are also printing machines with a vertical holder of the dabber or series of dabbers, in which the holder of the ink trough and block can move back and forth in a horizontal plane. In this case, the dabber-holder makes only vertical movements; printing of the workpiece with printing ink can then occur only when the holder of the trough and block is retracted.

SUMMARY OF THE INVENTION

The object of the invention is to provide a dabber printing machine whose efficiency is greater than that of known dabber printing machines. In addition, the indexing stations of the individual workpieces to be printed, i.e., the number of steps, should be reduced.

This aim in a dabber printing machine is achieved due to the fact that two holders, running parallel, in each case carrying at least a dabber, jointly and simultaneously make vertical and horizontal movements in a path in the form of an inverted U, whereby a step of operation of the transfer element optionally occurs upon every first or every second horizontal movement, and the workpieces to be printed are concentrically positioned under the path of the horizontal movement of both dabber-holders.

Advantageously, the dabber or series of dabbers of a dabber-holder takes up the printing ink from a block upon each vertical downward movement, and the other dabber or series of dabbers at the same time deliver to the workpiece to be printed the printing ink taken up from the other block.

BRIEF DESCRIPTION OF THE DRAWINGS

Various other objects, features and attendant advantages of the present invention will be more fully appreciated as the same bcomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
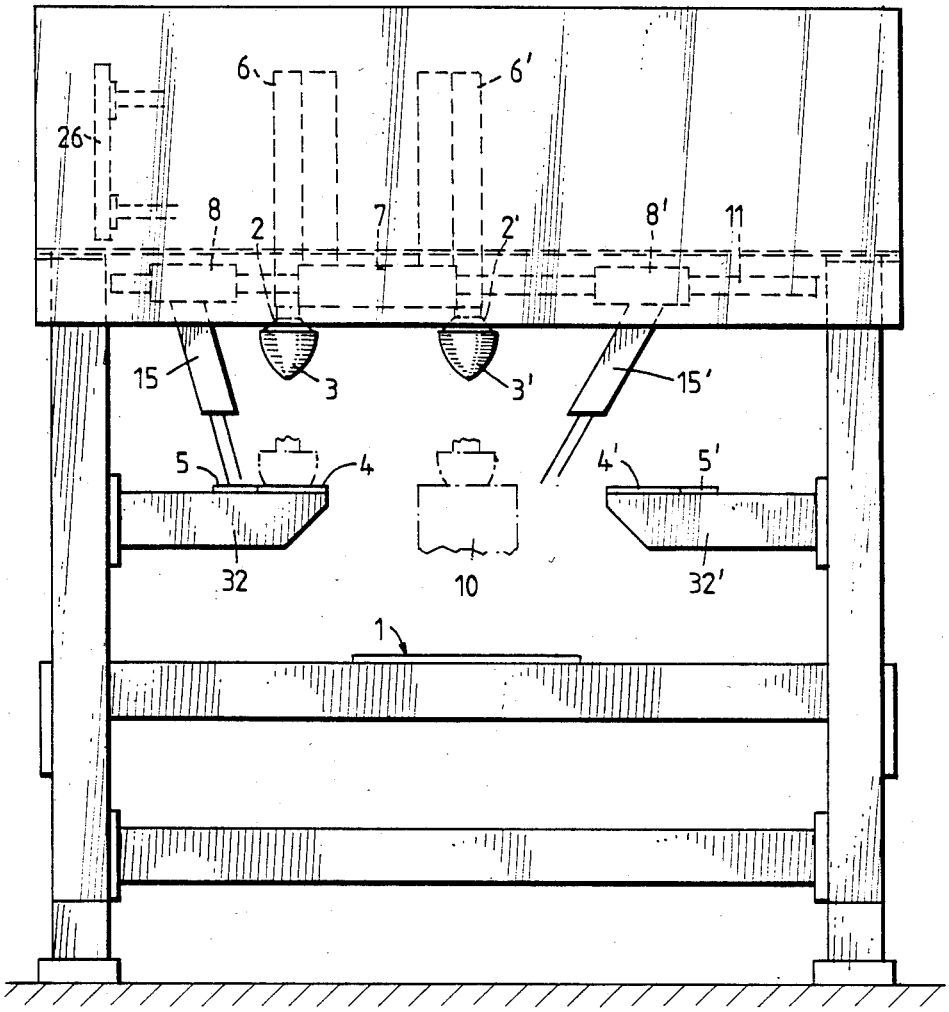
FIG. 1 is a front view of the dabber printing machine according to the invention.
Figure 3:
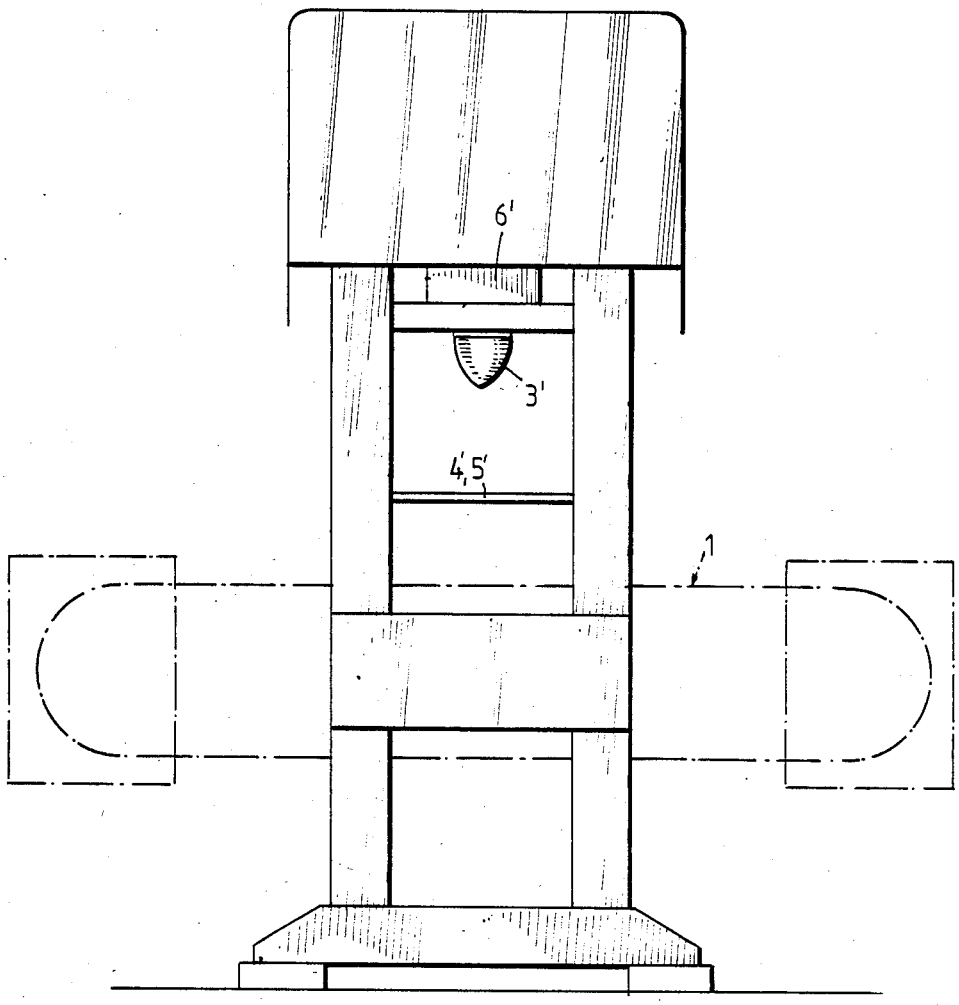
FIG. 3 is a side view of the printing machine according to FIG. 1 with a transfer element.

The dabber printing machine shown in the Figures is intended for printing of workpieces 10 with printing ink, said workpieces being put in a transfer element 1 which moves step by step in the same horizontal plane (see FIGS. 1, 3). A timed transfer of the workpieces from printing station is performed by transfer element 1 as a function of the work cycle of the printing machine. The dabber printing machine can be used for one- to four-color printing. The dabber printing is suitable for printing on various materials such as plastic, wood, metal, glass, ceramic, etc.

A dc motor 25, whose speed can be made infinitely variable, drives two drive shafts 9, 9' of the printing machine by a belt 26. Drive shafts 9, 9' run parallel to one another. Two gear units 12 are placed on each drive shaft which rotate constantly. The connecting element between drive shafts 9, 9' and each gear unit 12 is, in each case, a clutch/brake combination 18, 19 (see FIGS. 4, 5).

Figure 6:
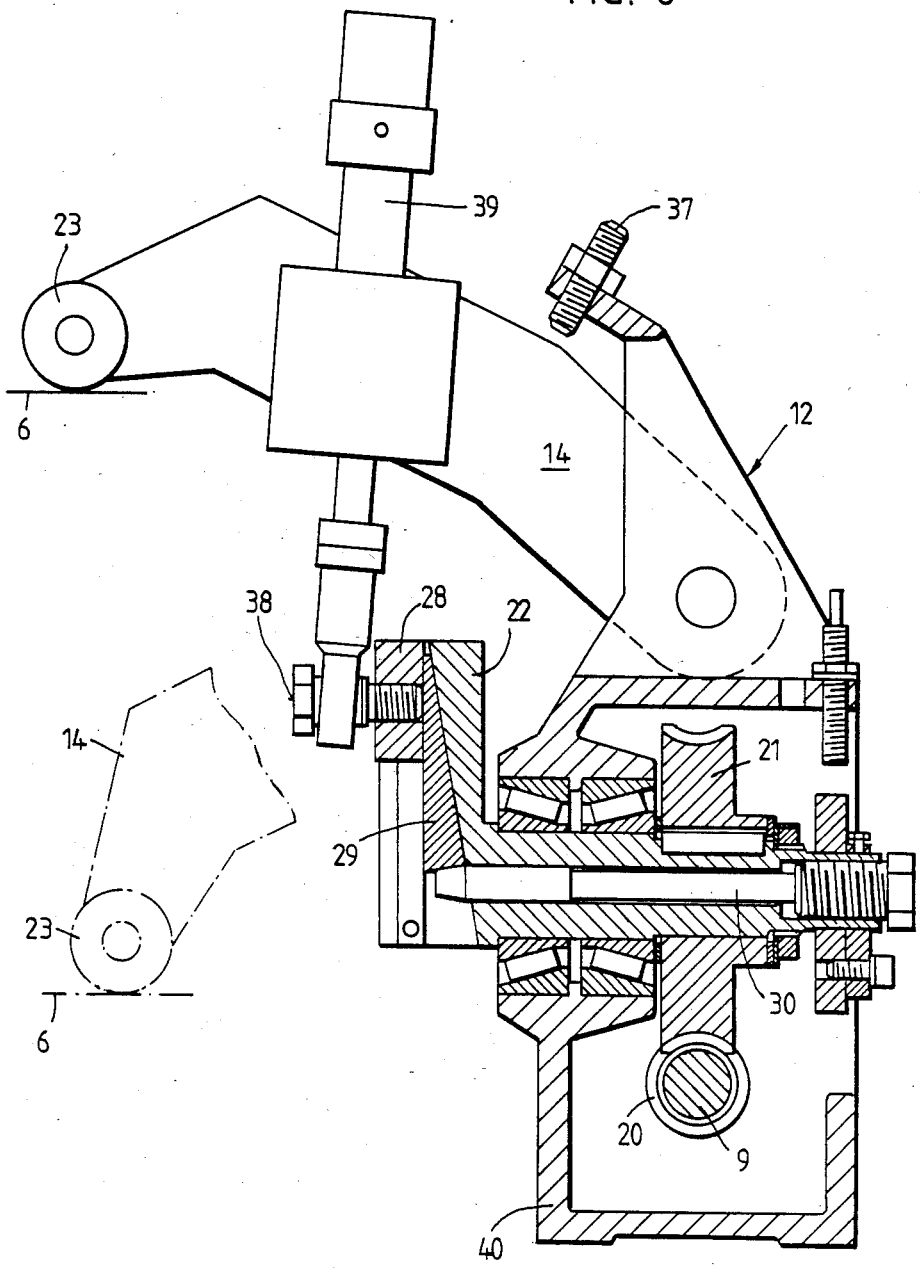
FIG. 6 is a view in section of a gear unit.
Figure 10:
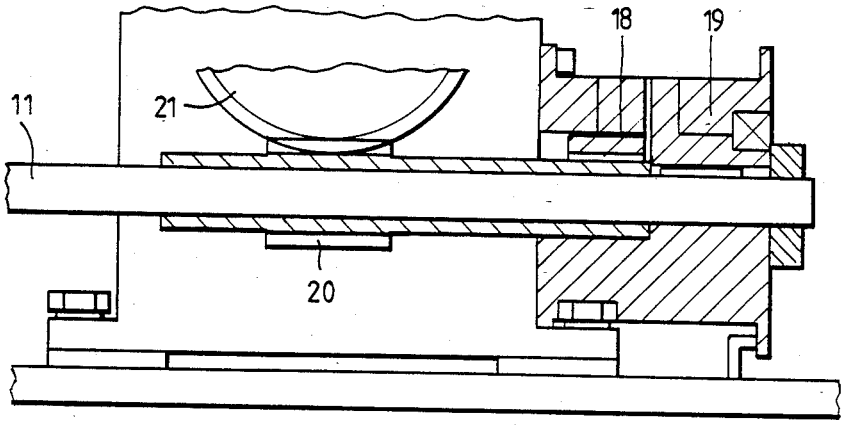
FIG. 10 is a longitudinal sectional view of the clutch and brake arrangement on a gear unit.

Each gear unit 12 comprises a hollow shaft with worm 20, said worm being meshed with a worm gear 21, which drives a crankshaft 22. Crankshaft 22 is in working connection with a swiveling lever 14, which on its free end carries a rotating roller 23 (see FIGS. 6, 10).

On one of the drive shafts 9, 9' is further placed a drive unit 13 which is also provided with a clutch/brake combination 18, 19. This unit also exhibits a hollow shaft with a worm, which is meshed with a worm gear that drives a crankshaft 22. Crankshaft 22 is in working condition with a link rod 24 which transmits the rotating movement of crankshaft 22 to feed lever 16 (see FIGS. 4, 5).

Figure 7:
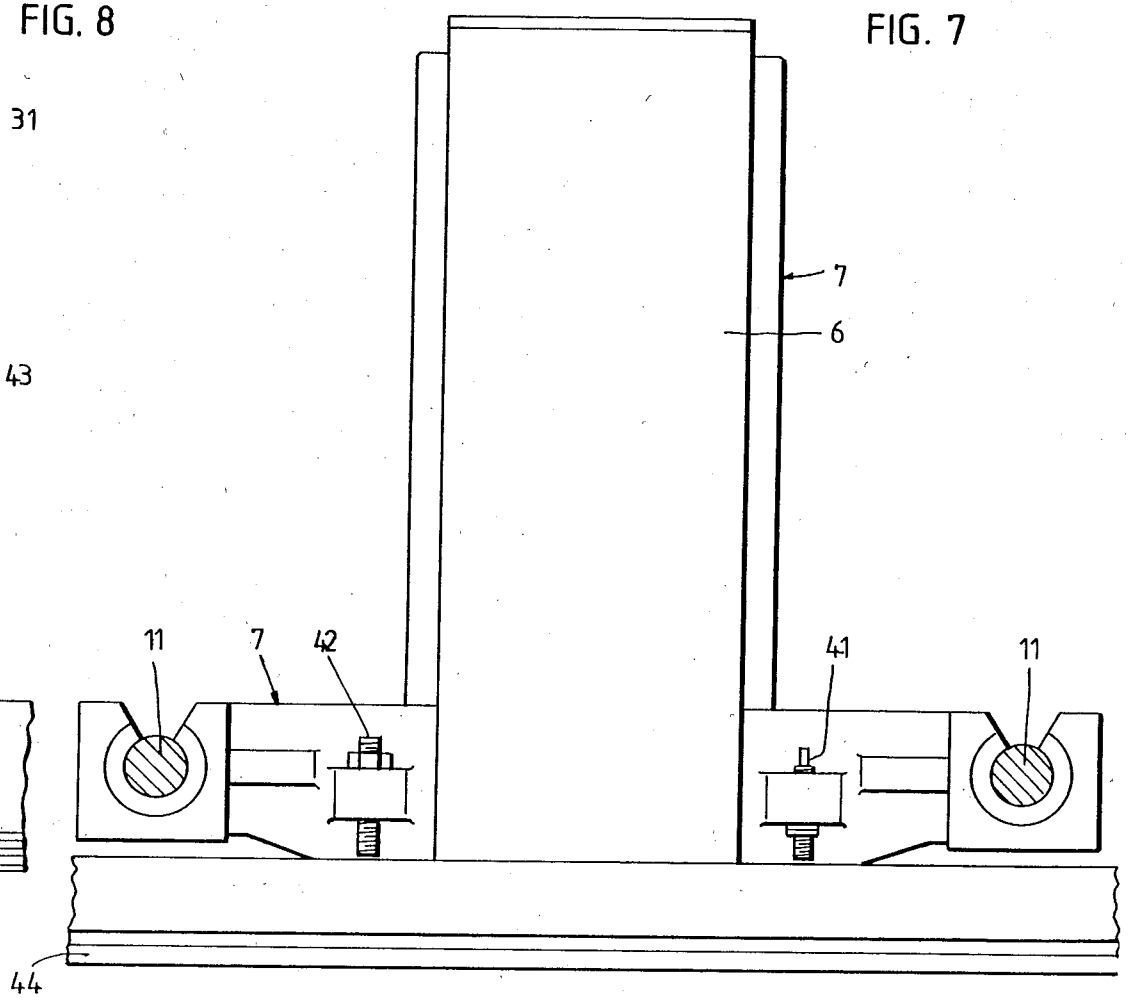
FIG. 7 is a view of the horizontal carriage with one of the vertical carriages.
Figure 8:
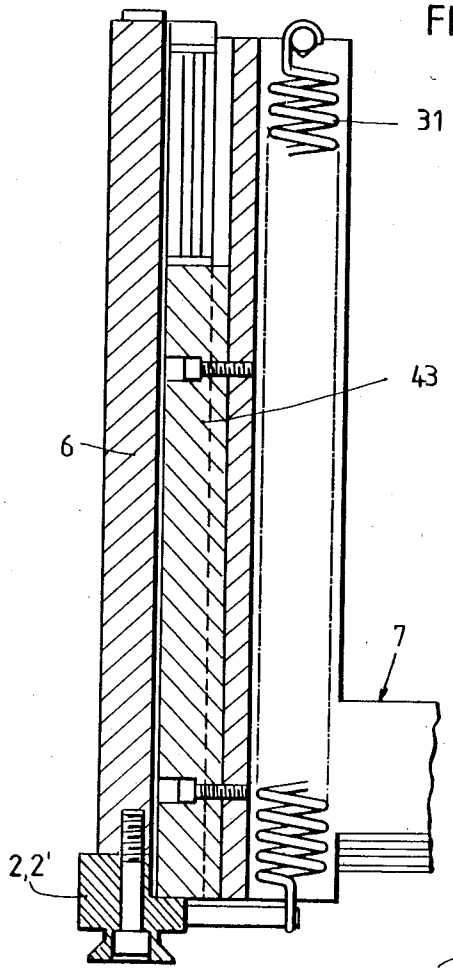
FIG. 8 is a longitudinal sectional view of the vertical carriage according to FIG. 7.
Figure 9:
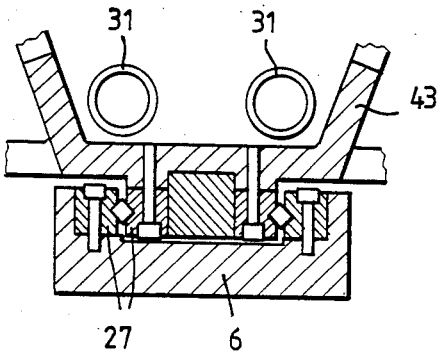
FIG. 9 is a cross sectional view of the vertical carriage with the guide table.

A traveling horizontal carriage 7 is placed on two guide shafts 11 that are separated from one another but run parallel. Two vertically movable carriages 6, 6' are connected to horizontal carriage 7. Each vertical carriage 6, 6' is placed in horizontal carriage 7 to be vertically guidable on guide piece 43 with roller bearing 27. A sensor is indicated by reference number 41 and a stop screw by 42 (see FIGS. 7, 8, 9).

A doctor knife carriage 8, 8', with a holder 15, slanted downward for the doctor knife and spatula, is provided in each case on both sides of horizontal carriage 7 with the two vertical carriages 6, 6'. Doctor knife carriages 8, 8' are able to travel on guide shafts 11 simultaneously with horizontal carriages 7, in each case, by means of two feed levers 16 and feed linkages 17 which are flexibly connected with one another. One of feed levers 16 is flexibly connected with linkage 24 of drive unit 13.

Figure 4:
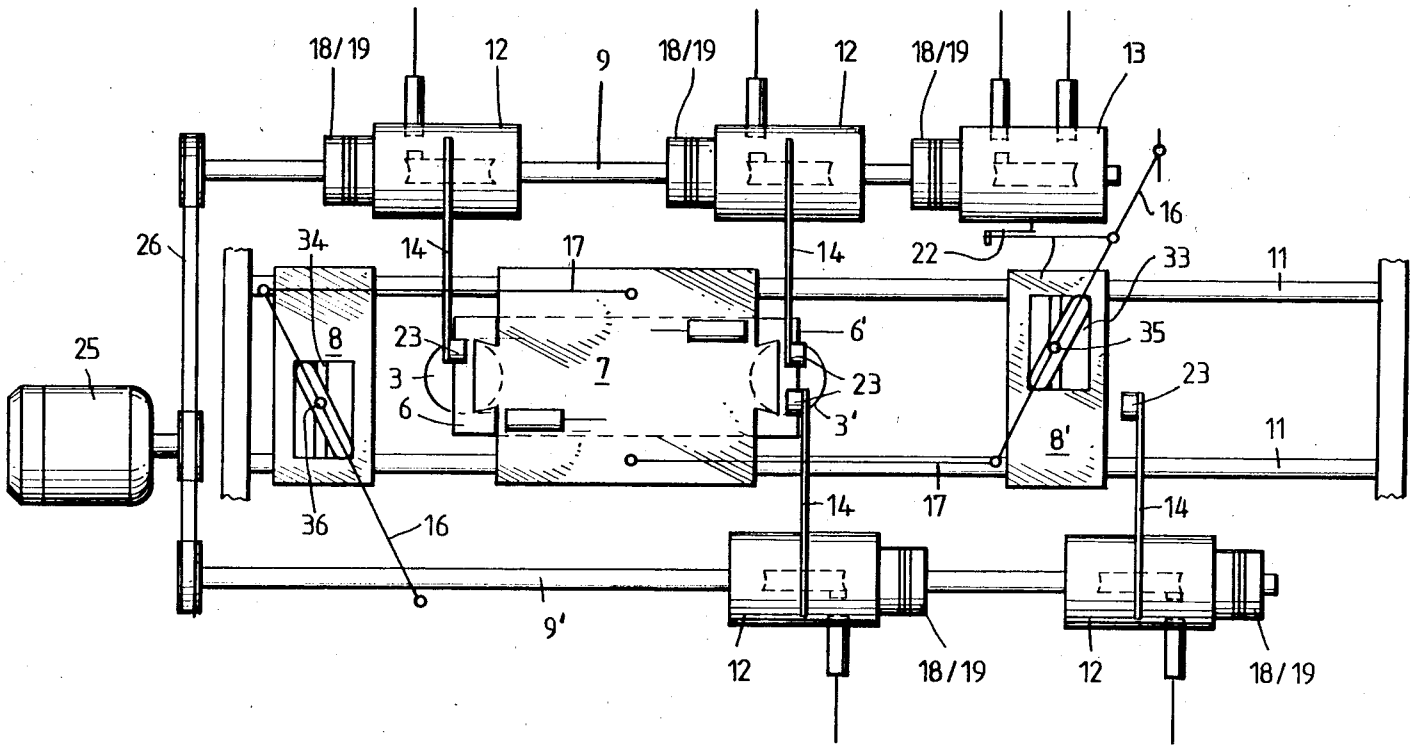
FIG. 4 is a diagrammatic top view of the dabber printing machine, whereby the horizontal carriage with both vertical carriages is in one extreme position.
Figure 5:
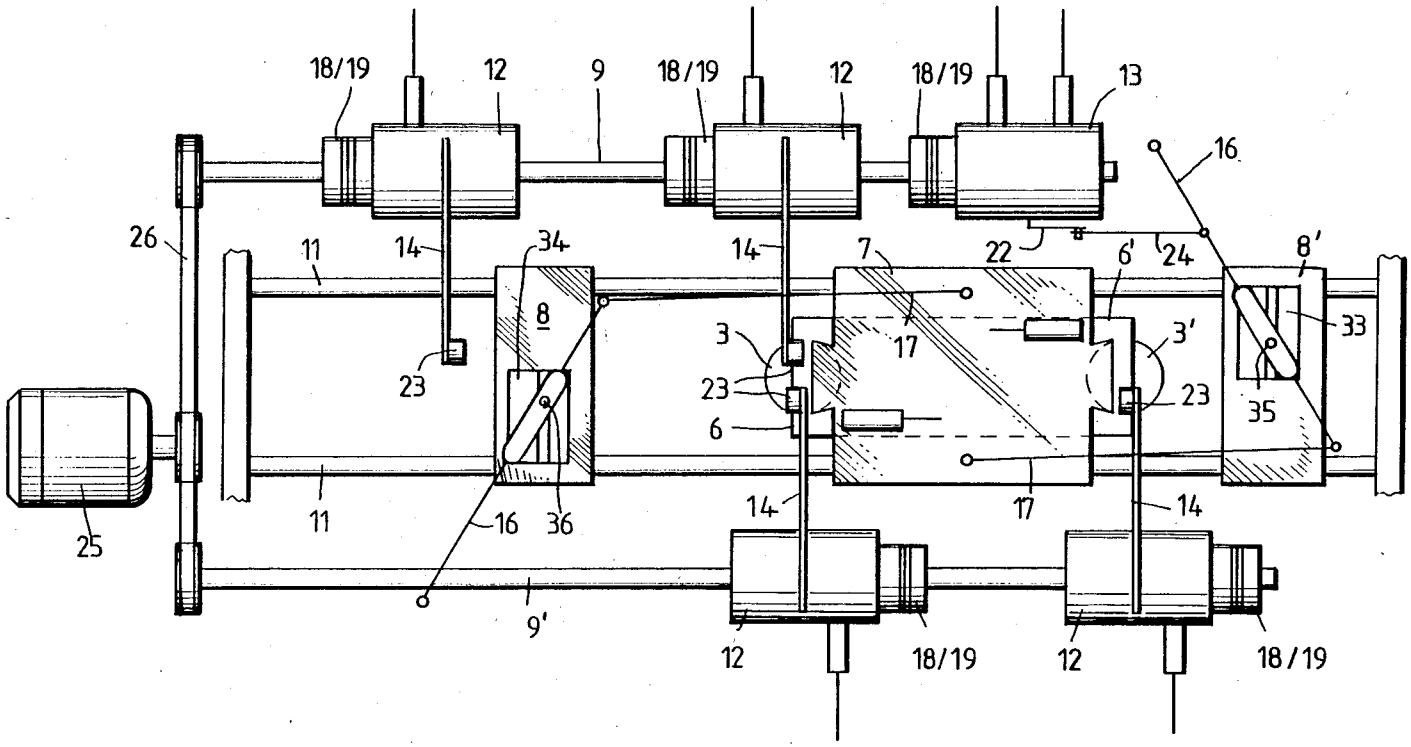
FIG. 5 is a diagrammatic top view of the dabber printing machine, whereby the horizontal carriage with both vertical carriages is in the other extreme position.

The feed linkages 17 are hinged on horizontal carriage 7 (see FIGS. 1, 4, 5).

Gear units 12 are operated crosswise in pairs; the hollow shafts with worm 20 of the two gear units placed on drive shafts 9, 9' in each case, are driven when electric clutches 18 are applied. The two levers 14 of the pair carried in a swinging movement whereby they press on vertical carriages 6, 6' in one of their positions. In the other position of vertical carriages 6, 6', which is reached by the horizontal movement of horizontal carriage 7, the vertical carriages are pressed downward by the swinging movement of the levers of the other pair of gear units 12. A sliding block 28, which can be clamped by a wedge 29 and a tightening screw 30, is placed on each crankshaft 22. A stop screw for lever 14 is indicated by reference number 37, a bearing screw by 38, a set screw by 39 and the gear case by 40 (see FIG. 6).

A dabber-holder 2, 2' is fastened from below to each vertical carriage 6, 6', said holders running parallel to one another. Each holder 2, 2' carries a dabber 3, 3' or a series of dabbers (see FIG. 8). Dabbers 3, 3' consist of a tough, highly resilient special silicon and are intended to transfer printing ink from a block 4, 4' to the workpiece 10 that is to be printed.

During operation, the two dabber-holders 2, 2' jointly and simultaneously make vertical and horizontal movements in a path in the form of an inverted U. A step of transfer element 1 from printing station to printing station occurs optionally at every or every other horizontal movement of the dabber-holders 2, 2'. Both holders 2, 2' with dabbers 3, 3 ∝ or the series of dabbers simultaneously guide the vertical and horizontal movements. In this way, workpieces 10 to be printed are concentrically positioned under the path of horizontal movement of the two dabber-holders 2, 2'.

Each vertical movement consists of a downward and an upward movement. The downard movement is produced by the pressure of levers 14 on vertical carriage 6, 6', while the upward movement is produced by the action of helical springs 31. Upon each vertical downward movement of dabber-holders 2, 2', dabber 3 of a dabber-holder 2 takes up the printing ink from a block 4 placed on the other dabber-holder 2' and at the same time transfers to workpiece 10 to be printed the printing ink picked up from the other block 4' which is placed on a block-holder 32' and is under dabber 3'. As a result, the path of movement of horizontal carriage 7 corresponds to the path of movement of the two dabber-holders 2, 2'.

Slides 33, 34, which are fastened to slides on doctor knife carriage 8, 8', are moved simultaneously with the horizontal movement of horizontal carriage 7. The doctor knife and spatula holder 15, which is connected to each doctor knife carriage 8, 8', is provided with a doctor knife and an ink spatula, which run parallel to one another and represent an inking and doctor arrangement. The appropriate block 4, 4' is inundated by the moving spatula with the printing ink taken from ink trough 5, 5' and then wiped clean by the doctor knife. Slides 33, 34 are driven by feed levers 16 and the curved rollers 35, 36 belonging to them. The amplitudes of both slide movements are determined by the position of guide rollers 35, 36 (see FIGS. 4, 5).

Since each gear unit 12 and drive unit 13 are set in motion by a clutch/brake combination 18, 19 with constantly rotating drive shafts 9, 9', it is advantageous to use a freely programmable electronic control (not shown), since any conceivable possibility of control of a clutch/brake combination 18, 19 is simple to program.

Figure 2:
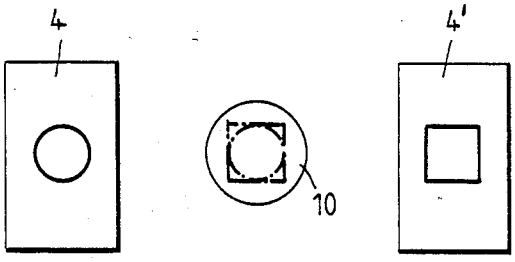
FIG. 2 is a plan view, diagrammatic representation of two blocks with different patterns and a workpiece.

In the printing machine described above, any pattern can be broken into two partial patterns and printed with only one ink, whereby in a complete cycle the two parallel patterns are transferred to workpiece 10 (see FIG. 2). It is further possible with the printing machine to print a workpiece in two colors. For this purpose, ink troughs 5, 5' are provided with different printing inks. But it is also possible to place side by side two pairs of ink troughs each with two pairs of blocks, in which case, of course, a corresponding series of dabbers must be provided on both dabber-holders 2, 2', whereby four-color printing on a workpiece 10 can be achieved. In all these cases, a step of operation of transfer element 1 occurs at every other horizontal movement.

It is also conceivable that each workpiece 10 is printed only with one color or with one pattern, in which case a step of operation of transfer element 1 occurs at every movement.

The advantages of this printing machine consist of the fact that the indexing for the workpiece to be printed is simplified and the efficiency is doubled. The distance of the patterns on the block must be precisely the same size as the transfer step; this calls for the transfer step from stroke to stroke to be precisely the same size. Preciseness for positioning of workpieces is not essential for two-color printing.

What is claimed as new and desired to be secured by Letters Patent of the United States is:

1. A dabber printing machine for printing of workpieces with printing ink, comprising:

a transfer element for moving said workpieces step by step in a horizontal plane;

at least a first and second dabber;

a first and second block containing said printing ink;

at least one ink trough;

an inking and doctor assembly;

first and second holder running parallel to one another and each carrying at least one of said first and second dabbers and which are jointly and simultaneously vertically and horizontally movable in a straight-lined path of an inverted U such that stepwise operation of said transfer element occurs upon every first or second horizontal movement of said first and second holders and wherein said workpieces to be printed are concentrically positioned under a straight-lined path of horizontal movement of said first and second holders; and a first and second vertical carriage such that each of said first and second holders is fastened from below to said first and second vertical carriage, respectively; a common drive shaft; a plurality of swiveling levers pressable from above on said first and second vertical carriages for producing downward movement of said first and second carriages; and first and second gear units placed on said common drive shaft by means of said swiveling levers.

2. A dabber printing machine according to claim 1, further comprising a drive unit placed on one end of said drive shaft, a pair of guide shafts, and a horizontal carriage wherein said first and second vertical carriages are connected to said horizontal carriage, which is moveable on said guide shafts by means of said drive unit.

3. A dabber printing machine according to claim 2, wherein a path of movement of said horizontal carriage corresponds to said straight-lined path of horizontal movement of said first and second holders.

4. A dabber printing machine according to claim 1, wherein each of said first and second gear units includes a crankshaft and a worm gear, each of said first and second gear units and said drive unit further comprise an electric clutch, a brake and a hollow shaft having a worm, and wherein said worm is meshed with said worm gear for driving said cranksahft and is driven by said electric clutch.

5. A dabber printing machine according to claim 4, further comprises a link rod wherein said crankshaft of said first and second gear units is connected with said link rod.

6. A dabber printing machine according to claim 4, further comprising freely programmable electric control means for controlling said electric clutch and said brake.

7. A dabber printing machine for printing of workpieces with printing ink, comprising:

a transfer element for moving said workpieces step by step in a horizontal plane;

at least a first and second dabber;

a first and second block containing said printing ink;

at least one ink trough;

an inking and doctor assembly;

first and second holders running parallel to one another and each carrying at least one of said first and second dabbers and which are jointly and simultaneously vertically and horizontally movable in a straight-lined path of an inverted U such that stepwise operation of said transfer element occurs upon every first or second horizontal movement of said first and second holders and wherein said workpieces to be printed are concentrically positioned under a straight-lined path of horizontal movement of said first and second holders; and a doctor knife carriage having a holder slanted downwardly and positioned on opposite sides of said holder carriage and first and second feed levers and a plurality of feed linkages flexibly connected with one another for allowing said doctor knife carriage to travel on said guide shafts such that one of said first and second feed levers is operated by said drive unit and wherein said feed linkages are hinged on said horizontal carriage.

* * * * *